US006494707B1

(12) United States Patent
Melcher et al.

(10) Patent No.: US 6,494,707 B1
(45) Date of Patent: Dec. 17, 2002

(54) LIMITED RECYCLE FOR PRIMARY CONTROLS

(75) Inventors: Amy L. Melcher, Minneapolis, MN (US); Richard W. Simons, Golden Valley, MN (US); Henry E. Troost, IV, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/621,259

(22) Filed: Jul. 21, 2000

(51) Int. Cl.[7] ..... F23N 5/20

(52) U.S. Cl. ..... 431/6; 431/27; 431/70; 431/71

(58) Field of Search ..... 431/20.6, 27, 70, 431/71, 31, 61, 69, 30

(56) References Cited

U.S. PATENT DOCUMENTS 4,445,841 A * 5/1984 Tanaka et al. ..... 431/27
4,695,246 A 9/1987 Beilfuss et al.
4,976,605 A * 12/1990 Geasry ..... 431/27
5,271,556 A 12/1993 Helt et al.
5,348,466 A * 9/1994 Momber ..... 431/70

FOREIGN PATENT DOCUMENTS

EP 0282644 A 9/1988
EP 02298721 A 11/1990

OTHER PUBLICATIONS

Donnely D E Et Al: An Intelligent Ignition System, IEEE Industry Applications Magzaine, IEEE Center, US. vol. 3, No. 3, May 1, 1997.
Honeywell Brochure: R4184D; R8184G, M, N, P Protectorelay® Oil Primary Controls.

* cited by examiner

*Primary Examiner*—James C. Yeung
(74) *Attorney, Agent, or Firm*—Kris T. Fredrick

(57) ABSTRACT

An oil burner control system is disclosed in which recycling between a loss of combustion to re-establishment of combustion is limited by counting the number of times recycling occurs and causing a the system to stop recycling and go to lockout after the count reaches a predetermined value.

20 Claims, 1 Drawing Sheet

LIMITED RECYCLE FOR PRIMARY CONTROLS

BACKGROUND OF THE INVENTION

1. Field of the Invention

The present invention relates to oil burners and more particularly to an oil burner system that will prevent or reduce problems such as soot accumulation due to unlimited recycling under inadequate combustion conditions.

2. Description of the Prior Art

In our co-pending patent application entitled "Pump Purge for Oil Primary", Ser. No. 09/621,257 filed and Jul. 21, 2000 assigned to the assignee of the present invention, an oil burner system which provides hardware and software that allows the system to be quickly primed or purged when necessary without entering a number of unwanted lockouts is described and claimed. In the normal operation of that system, after "Power On" occurs and various checks are made, an "Idle State" is entered where the system awaits a "call for heat" from a thermostat. When this arrives, a controller starts the ignition process, the flame is established and the system goes to a normal "Run State" in which the furnace supplies heat until the call for heat from the thermostat disappears. Sometimes in the normal Run State, the flame can go out before the call for heat from the thermostat ends. This is usually caused by a transitory condition such as an air bubble in the fuel line. When the flame in the burner goes out after having been established and before the thermostat stops calling for heat, the system goes into a "Recycle State" which, after a delay (recycle time), the system reverts to the Idle State where it receives the continued call for heat from the thermostat and the controller starts the ignition process and again initiates a flame. The system then returns to its normal Run State. Unfortunately, the condition causing the flame out may not have disappeared; for example when the system does not support combustion after the igniter turns off. When this occurs, the flame will again extinguish putting the system back in the Recycle State again and an endless cycle to the Run State, the Recycle State, the Idle State etc. may occur. This endless recycling is often due to a poor combustion situation and thus excessive soot may develop, excessive wear on components may result, and other damage may occur.

BRIEF DESCRIPTION OF THE INVENTION

The present invention overcomes the above problems by providing a recycle limit on the number of times that the system can recycle during a predetermined period.

This is accomplished with a recycle timer and logic for the microprocessor in the Primary Control so that the oil burner is restricted to going through the recycle mode a predetermined number of times (for example three), unless the call for heat is satisfied or power is removed. If the system enters the Recycle State more than the predetermined number of times it will go into a "Lockout State" that requires manual intervention to reset the control.

DETAILED DESCRIPTION OF THE PREFERRED EMBODIMENTS

Figure 1:
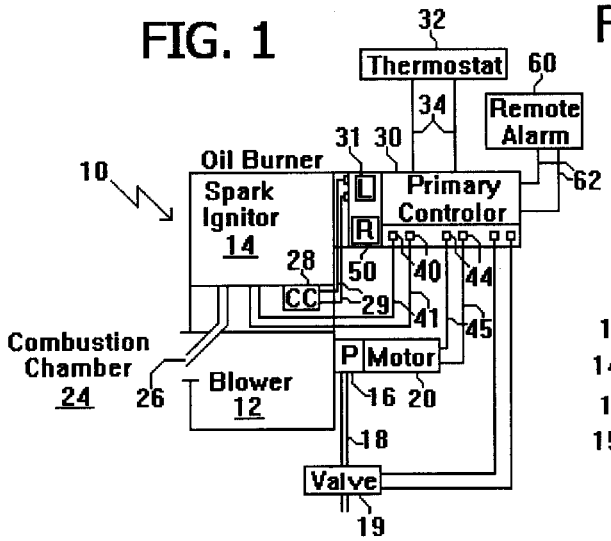
FIG. 1 is a block diagram showing the burner control system of the above mentioned co-pending application.

In FIG. 1, an oil burner 10 is shown having a blower 12 in the lower portion thereof and a spark igniter 14 in the upper portion there of. A pump 16 is shown attached to the blower 12 and a supply conduit 18 connects pump 16 to a valve 19 that is connected to a source of oil (not shown). A motor 20, which operates blower 12 to produce a stream of air, is shown also attached to pump 16. Pump 16 is operable by motor 20 to pump a fine mist of oil combined with the stream of air through blower 12 and into a combustion chamber 24 of a furnace (not shown). The spark igniter 14 employs a pair of spark electrodes 26 which, when energized, produce a spark across the gap therebetween to ignite the mist of oil and swirl the burning fuel into the combustion chamber 24 where the heat generated will be circulated to the area to be heated. A flame detector such as a cad cell 28 views the combustion area to determine whether or not ignition has occurred and sends a signal indicative thereof via lines 29 to a primary controller 30 and an indicator light 31.

The primary controller 30 is shown receiving signals from a thermostat 32 over lines 34, and acts to control the operation of the oil burner 10. More particularly, when thermostat 32 sends a signal calling for more heat, primary controller 30 sends a signal from terminals 40 over lines 41 to the spark igniter 14 that then operates to produce a spark across the gap between electrodes 26. Primary controller 30 also sends a signal from terminals 44 via lines 45 to energize motor 20 and pump 16 to start the mist of oil and air flowing from the blower 12 to combustion chamber 14. If the oil and air are present and the spark ignites the oil, then the flame detector 28 provides a signal via lines 29 to controller 30 and light 31 to show that satisfactory operation has occurred. Thereafter, when the flame is determined to be self sustaining, the spark igniter 14 is turned off and the furnace produces heat until the call for heat is lost, and the motor 20, blower 12 and pump 16 are shut off.

It should be understood that controller 30 contains, among other things, a RAM, a ROM, at least a portion of which is non-volatile, an EEPROM for storing values to be utilized in timing etc. and a plurality of DIP switches for storing certain predetermined constant values to be used. Also, in FIG. 1 is a reset button 50 which will be described below and a remote alarm 60 connected to the primary controller 30 by lines 62 for purposes of producing an alarm (for example to the home security system) that can alert that a problem has occurred in the system and that service should be performed as will be further explained below.

Figure 2:
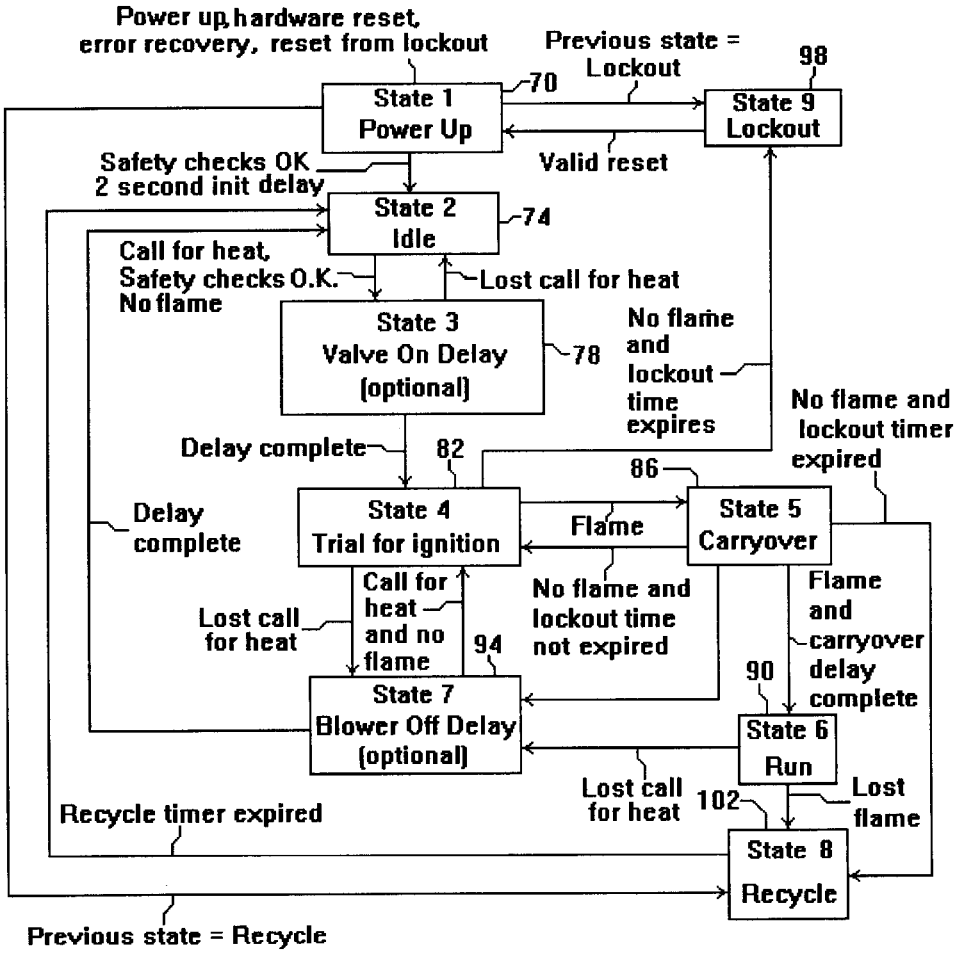
FIG. 2 is a state diagram showing various states of operation of the system of FIG. 1.

FIG. 2 shows the various states that can be occupied by the system of FIG. 1. A simplified explanation of FIG. 2 is as follows:

Upon "Power up", State 1, shown by box 70, the primary controller 30 performs checks to verify that conditions which would preclude proper system are not present. The system then goes to Idle, State 2, shown by box 74, where it waits for a call for heat from thermostat 32. Upon receiving a call for heat, the system moves to Valve On Delay, State 3, shown by box 78, where the controller 30 performs certain safety checks, determines that there is currently no flame and then starts a timer to delay the opening of valve 19 until after motor 20 and igniter 14 are on. Upon completion of the timer, the system moves to Trial For Ignition, State 4, shown by box 82, where the controller 30 opens valve 19 and a stream of oil and air passes the igniter electrodes 26. When the flame is detected by cad cell 28 and a signal indicative thereof is sent to controller 30, the system moves to Carryover, State 5, shown by box 86, where another short delay occurs to assure that the flame is self sustaining at which time the igniter is extinguished and the system moves to an normal Run, State 6, shown by box 90, where heating continues until the call for heat is lost. When this occurs, the system moves to Blower Off Delay, State 7, shown by box 94, where the valve 19 is turned off and a timer allows the motor 20 to remain on a short time while the hot air is pushed through and out of the system. When this is done, the system returns to Idle, State 2 where it again waits for a call for heat.

In the event that the burner 10 is just being installed or has undergone extensive maintenance, the oil supply lines and filter may be dry in which case, the above procedure could result in a "no flame" condition at Trial For Ignition, State 4 and, after a delay, the system would go to Lockout, State 9, shown by box 98 where further operation is prevented until the reset button 50 is pushed which allows the procedure to start over again. However, this is permitted to occur only a predetermined number of times, for example twice, after which the system goes into a restricted lockout and cannot again be started by merely pushing the reset button 50. In order for a technician to get out of restricted lockout, the system provides that the reset button 50 can be pushed and held for an extended period, for example, 30 seconds, after which the system returns to the normal operation again. In order for the technician to avoid having to wait through several lockouts during an initial start up, the system allows the reset button to be pushed during States 3–5 (as long as there have been no previous lockouts since that last successful run) and the timing in State 4 is then increased to a value sufficient for the oil to fill the conduits and the filter and flame to be established. After the longer delay in State 4, the detection of flame would move the system to State 5, as before, and operation would continue as above described.

A more detailed description of the various States and their function may be had by referring the above-mentioned co-pending application.

If the system is operating in State 6, with the sustained flame heating the desired area, and the flame is lost, control goes to a Recycle, State 8, shown by box 102. In State 8, the system has had a proven flame that has subsequently gone out before the thermostat has indicated no further heat is needed. When this happens, the Recycle State 8 writes the state value to EEPROM. The blower motor, igniter and oil valve are turned off. The recycle timer (for example 60 seconds) is started and the indicator light 31 is flashed slowly to provide an indication that the system is in Recycle State. When the recycle timer expires, the indicator light 31 is turned off and the system goes back to the Idle State 2.

As mentioned above, the call for heat from thermostat 32 causes the system to repeat the sequence leading up to the Run, State 6. In the event that the flame goes out again, the same cycle is repeated. In order for the system to prevent endless repetition of the Recycle, State 8, and to prevent damage to the system and the area being heated, the present invention provides a limit on the number of time the recycle can occur. After this limit is reached, the system goes to Lockout, State 9, which prevents further operation until manual intervention occurs.

Figure 3:
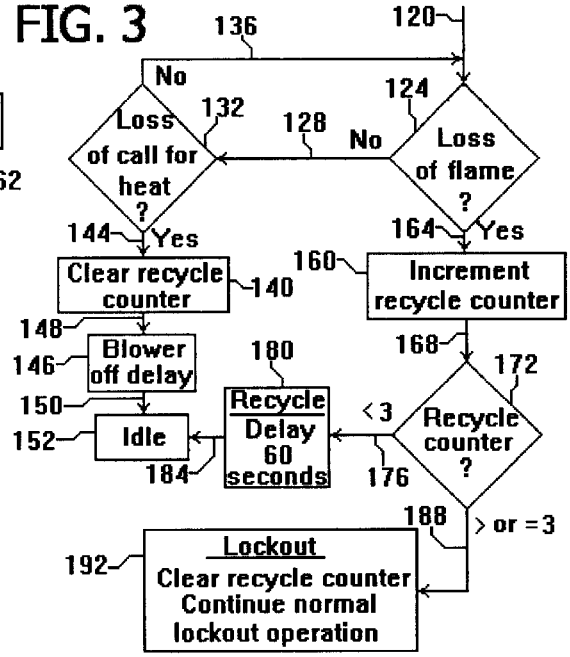
FIG. 3, is a flow diagram for the logic used in the present invention.

Referring to FIG. 3, the logic diagram for the present invention is shown and, it will be assumed that the system of the above mentioned co-pending application is in Run, State 6 of FIG. 2. While in Run, State 6, the system continually checks the flame and the call for heat. The procedure is shown starting with an arrow 120 in FIG. 3. The existence of a flame is checked as shown by diamond box 124. If there is no loss of flame, the answer is "no" as seen by arrow 128 and the system moves to diamond box 132 where the determination is made as to whether there has been a loss of a call for heat from thermostat 32. If the answer is "no", the system returns back to arrow 120 and diamond box 124 as shown by arrow 136. This cycle continues as long as there is flame and a call for heat. If there has been a loss of the call for heat, the answer, at diamond box 132 is "yes" and the system moves to box 140, as shown by arrow 144, where the recycle counter is cleared. Then, the system moves on to box 146, Blower off delay as shown by arrow 148. Blower off delay, box 146 corresponds to State 7 in FIG. 2 and, after the delay, the system moves, as shown by arrow 150, to Idle, box 152, which corresponds to State 2 of FIG. 2. As described above, when another call for heat from thermostat 32 is received, the system of FIG. 2 moves, to Valve On Delay, State 3, Trial For Ignition, State 4, and to Carry Over, State 5 to re-establish Run, State 6. This puts the system back at arrow 120 in FIG. 3.

If, in diamond box 124, it is determined that there is a loss of flame, the answer is "yes" and the system moves from diamond box 124 to box 160, as shown by arrow 164. At this position, the recycle counter is incremented by 1 and, the system moves, as shown by arrow 168, to diamond box 172, where a determination is made as to whether more or less than the predetermined number of recycles have occurred (in this case, three). If less than three, the system moves, as shown by arrow 176 to box 180 where a predetermined delay (in this case, sixty seconds) is introduced to allow cooling of the system and expulsion of combustion products and uncombusted fuel before attempting to restart the system. After the delay, the system moves to Idle, box 152 as seen by arrow 184, which, as explained above, is the same as Idle, State 2, box in FIG. 2. Thereafter, the system moves through Valve on Delay, State 3, Trial for Ignition State 4, and Carry Over, State 5 to Run, State 6. This, again, puts the system back to arrow 120 of FIG. 3.

In diamond box 172, if there have been three or more recycles, the system moves, as shown by arrow 188 to Lockout, box 192 where the recycle counter is cleared and the system is put in the Lockout condition, i.e., State 9 in FIG. 2. Thereafter the system will resume normal lockout operation explained above. After the reset button 50 is pushed system re-ignition may again occur and the process repeated as above until the flame stays on, the call for heat is lost or the return to Lockout, State 9, box 98, again occurs.

It is therefore seen that we have provided a limit for a burner system to prevent excessive recycling when a loss of flame occurs after having been established. Many changes and modifications will occur to those having ordinary skill in the art and we do not wish to be limited to the specific disclosures used in describing the preferred embodiment. For example, it will be understood that while the present invention has been shown to operate the oil-fired burner of a furnace, the invention may be used with boilers, water heaters and other equipment. Also, where a thermostat 32 has been shown to provide the call for heat, an Aquastat® or other heat detecting device may be employed. The number of recycles may be more or less than three and the recycle delay may be other than sixty seconds. Furthermore, many of the logic sequences disclosed may be considered optional and alternate sequences may be utilized.

The scope of the invention is set forth in the claims appended hereto.

What is claimed is:

1. In a burner control system having a combustion chamber into which fuel may be introduced, a heat sensor for producing a "call for heat" signal when heat is desired, an igniter for igniting fuel in the combustion chamber to produce combustion, a detector to determine when the fuel has been ignited and to determine the loss of combustion, and a primary controller operable upon a "call for heat" signal to move the system to a "trial for ignition" state where the igniter is energized to attempt to ignite the fuel in the chamber and a) when the flame detector establishes that the fuel has been ignited, the controller moves the system to a "run" state where continued heat is normally produced until the "call for heat" signal is removed, but b) when the flame detector establishes that the fuel has not been ignited, the controller moves the system to a "lockout" state" which requires nominal human intervention to energize the igniter to attempt to re-establish combustion again, and after the system reaches the "lockout" state a predetermined number of times, the controller operates to place the system in a "restricted lockout" state which requires special human intervention, to energize the igniter to attempt to re-establish combustion, the system being susceptible when the system is in the "run" state, to a loss of flame after which the controller moves the system to a "recycle" state where further attempts at ignition can be made, the system being subject to multiple recycling from the loss of combustion to re-establishing combustion and back, the improvement comprising:

a counter operable to count the number of times that the system recycles; and when the counter reaches a predetermined number to move the system to the "lockout" state.

2. Apparatus according to claim 1 further including:

delay means operable to introduce a predetermined delay time after each recycle before energizing the igniter to re-establish combustion.

3. Apparatus according to claim 1 wherein the system includes a fuel valve operable by the controller to prevent fuel flow when lockout occurs.

4. Apparatus according to claim 1 wherein the controller resets the counter when lockout occurs.

5. Apparatus according to claim 1 wherein the fuel is oil.

6. Apparatus according to claim 5 wherein the counter is reset whenever the "call for heat" signal is lost.

7. In a burner control system including a primary controller, a fuel control operable by the primary controller to supply fuel, an igniter operable by the primary controller to ignite the fuel, a detector to provide a signal indicative of whether or not the fuel is ignited, the controller operating in a first condition so that after there is a "call for heat", the system is placed in a "trial for ignition" state whereupon ignition is attempted and when the detector determines that a successful flame has resulted, the system moves to a "run" state until the call for heat is lost but, if no successful flame results, the controller places the system in a "lockout" state requiring nominal human intervention to re-try ignition, and upon reaching the "lockout" state a predetermined number of times the system is placed in a "restricted lockout" state requiring extraordinary human intervention to re-try ignition, the controller operating in a second condition so that after a successful ignition, if the detector produces a signal indicative of the fuel no longer being ignited, the controller operating to place the system in a "recycle" state and energize the igniter to attempt to return to the "run" state, the system being capable of continuing to cycle from the "recycle" state to the "run" state after loss of ignition and re-establishment of ignition, the improvement comprising:

a counter operable to count the number of times that the system recycles; and upon reaching a predetermined count by the counter, the controller placing the system in the "lockout" state.

8. The system of claim 7 further including delay means to introduce a predetermined delay after each recycle before a lockout occurs.

9. The system of claim 7 wherein the counter is cleared upon a lockout occurring.

10. The system of claim 7 wherein the controller causes the fuel control to stop delivering fuel and the igniter is de-energized upon a lockout occurring.

11. The system of claim 7 further including a device for producing a signal to the controller indicative of whether or not ignition of the fuel is desired and, if not, the fuel control and the igniter are de-energized, the counter is cleared and the system awaits a "call for heat" before further causing fuel ignition.

12. The system of claim 1 wherein the predetermined number is three.

13. The system of claim 8 wherein the predetermined delay is sixty seconds.

14. The method of preventing excessive recycling of a burner control system having a fuel supply, an igniter to ignite the fuel and a detector for indicating whether or not fuel ignition has been established, the system operating, to attempt ignition and after fuel ignition has been established to move to a "run" state normally until a "call for heat" is lost but when ignition is not established to move to a "lockout" state where with nominal human intervention, a predetermined number of attempts to establish ignition are tried and thereafter to move to a "restricted lockout" state where extraordinary human intervention is required for further attempts to establish ignition but when ignition has been established and is subsequently lost, the system operating in a "recycle" state to energize the igniter to re-establishes fuel ignition, comprising the steps of:

i. counting the number of times the system enters the recycle state; and, ii. moving the system to the "lockout" state after the count reaches a predetermined number.

15. The method of claim 14 further including the step of:

iii. de-energizing the igniter.

16. The method of claim 15 further including the step of:

iv. stopping the fuel supply.

17. The method of claim 14 further including the step of:

v. starting the counter at zero.

18. The method of claim 14 wherein the system responds to a loss of a "call for heat" to:

vi. de-energize the igniter; and, vii. stop the fuel supply.

19. The method of claim 18 further including the step of:

viii. starting the counter at zero.

20. The method of claim 14 wherein the count is less than the predetermined number, and further including the step of:

ix. producing a predetermined delay before re-establishing fuel ignition.

* * * * *